US005791065A

United States Patent [19]

Gamble et al.

[11] Patent Number: 5,791,065

[45] Date of Patent: Aug. 11, 1998

[54] GAS HEATED PAPER DRYER

[75] Inventors: David Gamble, Kennesaw, Ga.; Ian Gerald Lang, Dewittville, Canada

[73] Assignee: Asea Brown Boveri, Inc., Quebec, Canada

[21] Appl. No.: 796,844

[22] Filed: Feb. 6, 1997

[51] Int. Cl.[6] ..... A45D 21/00

[52] U.S. Cl. ..... 34/110; 34/117; 431/328; 165/89

[58] Field of Search ..... 34/179, 166, 181, 34/182, 92, 110, 111, 117; 431/280, 328; 165/89

[56] References Cited

U.S. PATENT DOCUMENTS

| | | | |
|---|---|---|---|
| 1,135,813 | 4/1915 | Kemp et al. | 431/281 |
| 2,480,281 | 8/1949 | Begerow | 239/66 |
| 2,603,457 | 7/1952 | Bishop | 165/89 |
| 2,793,006 | 5/1957 | Eaby | 165/89 |
| 2,869,630 | 1/1959 | Flynn | 431/280 |
| 2,984,472 | 5/1961 | Marks | 432/135 |
| 2,987,305 | 6/1961 | Calhoun, Jr. | 165/89 |
| 3,022,047 | 2/1962 | Swaney | 34/124 |
| 3,452,967 | 7/1969 | Durand | 432/228 |
| 3,501,098 | 3/1970 | Evans | 239/561 |
| 3,643,344 | 2/1972 | Strube | 165/89 |
| 3,662,821 | 5/1972 | Saxon | 165/89 |
| 3,675,337 | 7/1972 | Daane | 34/41 |
| 3,729,180 | 4/1973 | Bourrel et al. | 432/228 |
| 3,824,064 | 7/1974 | Bratko | 431/328 |
| 3,997,953 | 12/1976 | Christ et al. | 492/2 |
| 4,090,841 | 5/1978 | Kramlehner | 432/60 |
| 4,543,940 | 10/1985 | Krill et al. | 126/92 AC |
| 4,562,655 | 1/1986 | Bosshart et al. | 38/52 |
| 4,627,176 | 12/1986 | Brieu | 34/115 |
| 4,677,773 | 7/1987 | Kamberg | 38/44 |
| 4,688,335 | 8/1987 | Krill et al. | 34/41 |
| 4,693,015 | 9/1987 | Hemsath et al. | 34/41 |
| 4,774,747 | 10/1988 | Kurschatke | 29/110 |
| 5,240,666 | 8/1993 | Schnyder et al. | 264/175 |
| 5,347,937 | 9/1994 | Vatsky | 110/261 |
| 5,553,391 | 9/1996 | Bakalar | 34/110 |

FOREIGN PATENT DOCUMENTS

| | | |
|---|---|---|
| 716887 | 8/1965 | Canada . |
| 1286498 | 7/1991 | Canada . |
| 1303958 | 6/1992 | Canada . |
| 2160733 | 4/1996 | Canada . |
| 0 708 301A1 | 4/1996 | European Pat. Off. . |

*Primary Examiner*—Ronald C. Capossela
*Assistant Examiner*—Pamela A. O'Connor
*Attorney, Agent, or Firm*—Burns, Doane, Swecker & Mathis, L.L.P.

[57] ABSTRACT

A drying cylinder comprises a cylindrical shell with head members at either end and is mounted for rotation about its central longitudinal axis. A gas fired burner assembly is mounted in the interior of the cylinder and comprises a plurality of burner segments which transmit heat to the shell by infrared radiation. The heat output of the burner segments are controllable as an assembly in unison or individually.

7 Claims, 6 Drawing Sheets

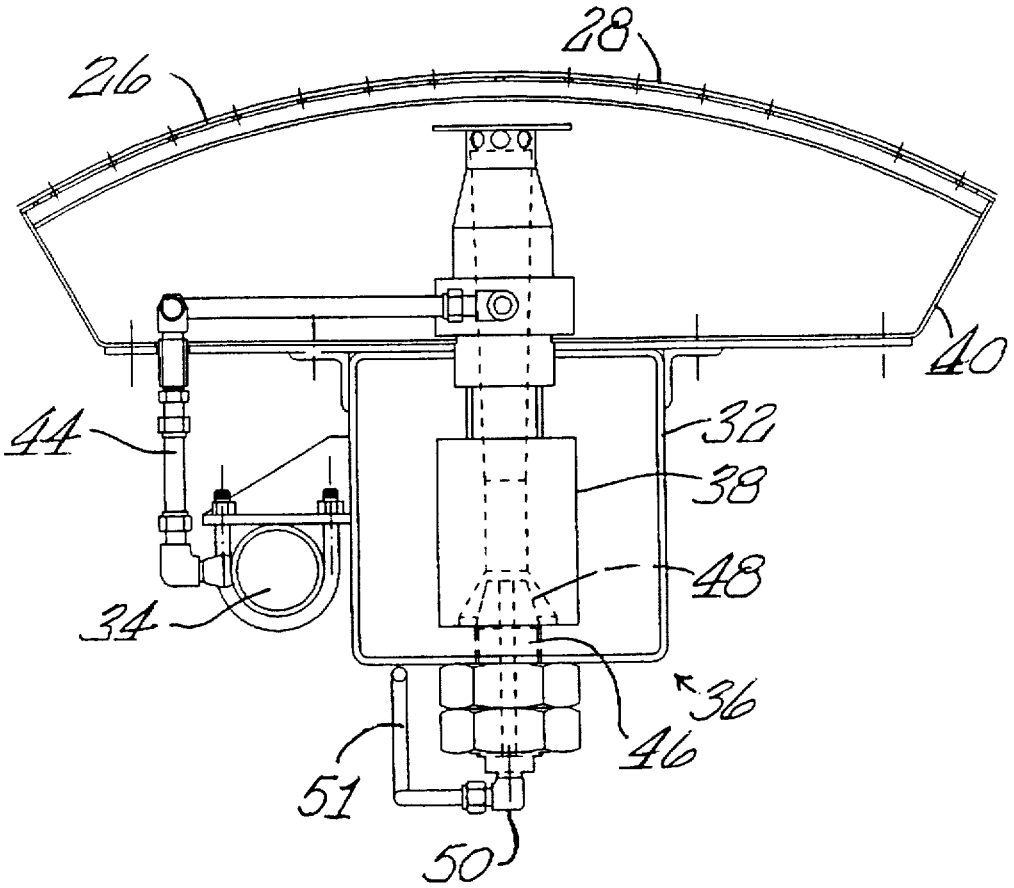
FIG·6·

GAS HEATED PAPER DRYER

FIELD OF THE INVENTION

This invention relates to drying devices for web materials and, in particular, to a gas heated cylinder dryer for use in drying web materials such as paper and/or textiles.

BACKGROUND OF THE INVENTION

Cylinder dryers are commonly used for the drying of web materials such as paper and/or textiles and the most common method for heating cylinder dryers is by the use of steam.

A typical, conventional cylinder dryer consists of a drum manufactured from cast iron or from rolled steel plate. At either end of the cylinder a dryer head, essentially a circular plate, is bolted to the drum. Journals, attached to the dryer head on the axis of the drum, are fitted with bearings to allow the cylinder to rotate freely. One or both of the dryer journals will be hollow to allow for the supply of steam and the removal of condensate into and out of the cylinder. Steam is piped into the dryer through special leakproof rotary joints and siphons mounted inside the dryer drum serve to collect the condensate which is then piped out of the dryer via the steam joint.

In order to obtain the high heat transfer rates necessary for high drying rates, it is necessary to heat the cylinder to high temperature. This entails the use of high pressure steam. However, pressure vessel design codes limit the pressure to which cylinders can operate and therefore in practice 150 psig is the upper limit. Thus, the upper limit of the cylindrical shell temperature is limited by the temperature of saturated steam at 150 psig or 365° F. The shell temperature is dependent on a number of factors such as the type of material being dried, its moisture content and the degree to which the material is held against the dryer surface. In practice, the drum temperature will rarely exceed 300° F.

To withstand the stresses caused by the internal high pressure steam, the cylinder shell thickness must be substantial, resulting in a heavy dryer. Moreover, the thick shell reduces the heat transfer through the surface of the cylinder so that the potential gains are not as great as those which could be obtained with a thin shell.

The steam supplied to the dryer is produced in a boiler which is heated by the combustion of fuel. Fossil fuels as well as wood waste products can be burned to provide heat. In an integrated wood pulp mill, black liquors from the pulp process are burned in a recovery boiler to produce steam.

Steam is supplied to the dryer from the boiler through a high pressure steam distribution system. The high pressure steam is usually piped to a device called a thermocompressor where it is mixed with low pressure flash steam from the dryer condensate tanks prior to entering the dryers at a lower intermediate pressure. The steam condenses on the inner wall of the dryer giving up its latent heat to the shell and then the condensate is collected in receivers and pumped back to the boiler through a separate piping system. Flash steam vented from the condensate receivers is then piped to the thermocompressor system.

In practice, the efficiency of a typical boiler is about 80 to 85%. The losses in the steam distribution system account for another 10 to 15% and heat losses in the drum account for a further 10%. T his means that as much as 45% of the energy consumed by the boiler is lost without contributing to the drying process.

Another drawback of steam heated dryers is that they do not provide any means to vary the heat output along the length of the dryer to correct for any cross-machine variations in web moisture content.

The dryer section of a conventional paper machine is quite long and usually consists of 30 to 60 or more cylindrical dryers each with its own steam joints and condensate siphons. The dryers are normally connected in groups of 6 to 10 or more to a steam control system which controls the pressure or flow to a group of cylinders. The first few cylinders are often controlled individually and generally run at lower steam pressure than the following sections to enable a gradual heating up of the paper web as operation of the first few dryers at too high a temperature may cause problems of the sheet sticking to the dryer.

In addition to being piped in groups the dryers are normally driven in groups. The usual method is to drive one cylinder per group by means of a shaft driven by an electric motor, the remaining cylinders in the group being driven by interconnecting gears. Alternatively the remaining cylinders can be driven by a dryer fabric.

The dryer fabric serves to support the paper web through the dryer section and hold it in intimate contact with the dryer surface. Each drive section has its own fabric, complete with fabric rolls and tensioning device.

Typically, the dryer section of a paper machine is enclosed by an insulated hood having a system of exhaust ductwork and fans for the removal of water vapour produced by the drying process as well as a system of supply ducts, fans and steam heating coils to deliver heated dry air at 200 to 250 degrees F. to the hood to replace the exhaust air.

One alternative method to heating drying cylinders is to use electricity.

Brieu, U.S. Pat. No. 4,627,176, proposed a segmented drying cylinder, with the temperature of each segment individually controllable, up or down by means of water cooling or electrical heating. The proposed device addresses the problems of steam heated dryers, vis a vis the heavy shell, the steam system and the difficulty of providing cross machine profiling but for drying large quantities of water it would be extremely expensive to operate.

An alternative to burning fuel in a boiler to create steam to heat the dryer is to have the combustion occur directly inside the dryer itself.

A number of designs of dryers heated by direct combustion have been proposed over the years.

Hemsath, U.S. Pat No. 4,693,015, proposed a direct fired cylinder which used high temperature, high velocity air jets impinging on the inside of the dryer.

Calhoun, U.S. Pat. No. 2,987,305, proposed direct flame impingement against the inside of a drum.

Both of the above designs overcome to some extent the problems associated with using high pressure steam. However the Hemsath design requires a sophisticated air circulating system which is complicated to build and maintain. Unlike the dryer proposed herein both designs rely on heat transfer from hot gas jets.

More recently, Krill U.S. Pat. No. 4,688,335 proposed a paper dryer heated internally by means of a radiant heat source, namely a circular infrared burner. The burner proposed does not incorporate any means to vary the heat input along its length.

Van der Veen, EP 0 708 301 A1, proposes a gas fired drying apparatus which also utilizes a number of radiant gas burners.

Bakalar, U.S. Pat. No. 5,553,391 proposes a similar method and apparatus for heat treating webs which utilizes a number of radiant surface burners mounted inside a dryer drum.

Both of the above address the issue of varying the heat input along the length of the dryer to allow for moisture profile correction.

SUMMARY OF THE INVENTION

A gas heated dryer according to the present invention can convert energy to the drying process at efficiencies of up to 70%. When operated in conjunction with an appropriate heat recovery system the conversion of energy from combustion to the drying process can be as high as 90%.

One advantage of direct combustion inside the dryer is that it may eliminate or reduce the need for a boiler and steam distribution system with their inherent inefficiencies.

Another, significant advantage is that the dryer no longer needs to be a pressure vessel as operation is at or near atmospheric pressure, therefore the dryer no longer has to be designed according to pressure vessel codes. This means that thinner materials can be used and the weight of the dryer and its associated framing reduced. The thinner shell offers less resistance to heat transfer therethrough and thus enhances heat transfer.

More significantly, because the dryer temperature is no longer limited by pressure vessel design codes, the dryer can be operated at temperatures substantially above those possible with steam heated dryers, the limit being more a function of dryer metallurgy. In practice, surface temperatures of from 500° to 600° F. can be obtained and drying rates up to 5 times greater than conventional steam heated dryers are possible.

The higher drying rates allow for a more compact installation than that possible with steam dryers.

To increase the drying capacity of a typical paper machine with steam would require that the dryer section be lengthened and more dryers added. This typically requires the extension of the machine frames and relocation of the calender, reel and winder not to mention building extension and structural works which make the modification expensive in terms of capital and time, with 3 to 4 weeks being the usual amount of time to carry out the work.

With the gas heated paper dryer the same result can be achieved by removing the necessary number of steam dryers and replacing them with gas heated paper dryers with no (or minimal, depending on the desired capacity) lengthening of the dryer section thus greatly reducing the cost and time required. If no dryer extension is required then only a few days of shutdown may be required.

Alternatively, the application of the gas heated paper dryer to a new paper machine would permit a dryer section 50% shorter than a conventional one; shorten the length of the machine room; eliminate much of the steam piping; and reduce the size of the steam plant, all factors which would contribute to lower overall costs.

The burner according to the present invention can be sectionalized so as to allow the thermal output to be varied along the dryer length to allow for correction of cross-machine variations.

This invention includes a method by which the dryer is heated internally by a gas burner, more specifically an infrared burner, which is divided into individually controllable segments thus allowing the heat input into the dryer to be varied along its length and providing a means to correct for variations in web moisture content.

The dryer is fitted with internal baffles to augment the transfer of heat from the combustion products to the dryer by means of convection heat transfer.

To further enhance the thermal efficiency of the dryer it may be equipped with an internally mounted tubular heat exchanger to pre-heat the combustion air with the combustion gases.

From the dryer drum the exhaust gas is then directed to a suitable heat recovery system. The most logical use of the hot gases is to duct them directly to the hood ventilation system where 100% of the heat in the exhaust gas is recovered.

According to a broad aspect, the invention relates to a gas fired drying cylinder comprising a cylindrical shell having end wall heads secured thereto, an interior surface and an exterior surface over which a material to be dried is engaged, the drying cylinder being mounted for rotation about its central longitudinal axis; a burner assembly non-rotatably disposed within the cylinder and located adjacent the dryer shell interior for burning a fuel/air mixture to transfer hot combustion gases by convection and infrared radiation about the interior of said dryer shell; the burner assembly having a plurality of burner segments along the length thereof, the heat output of said burner segments being individually controllable or controllable in unison.

DESCRIPTION OF THE DRAWINGS

The invention is illustrated by way of example in the accompanying drawings in which:

FIG. 6 is a sectional view similar to FIG. 5 with the secondary air injection shown.

DESCRIPTION OF THE INVENTION

Figure 1:
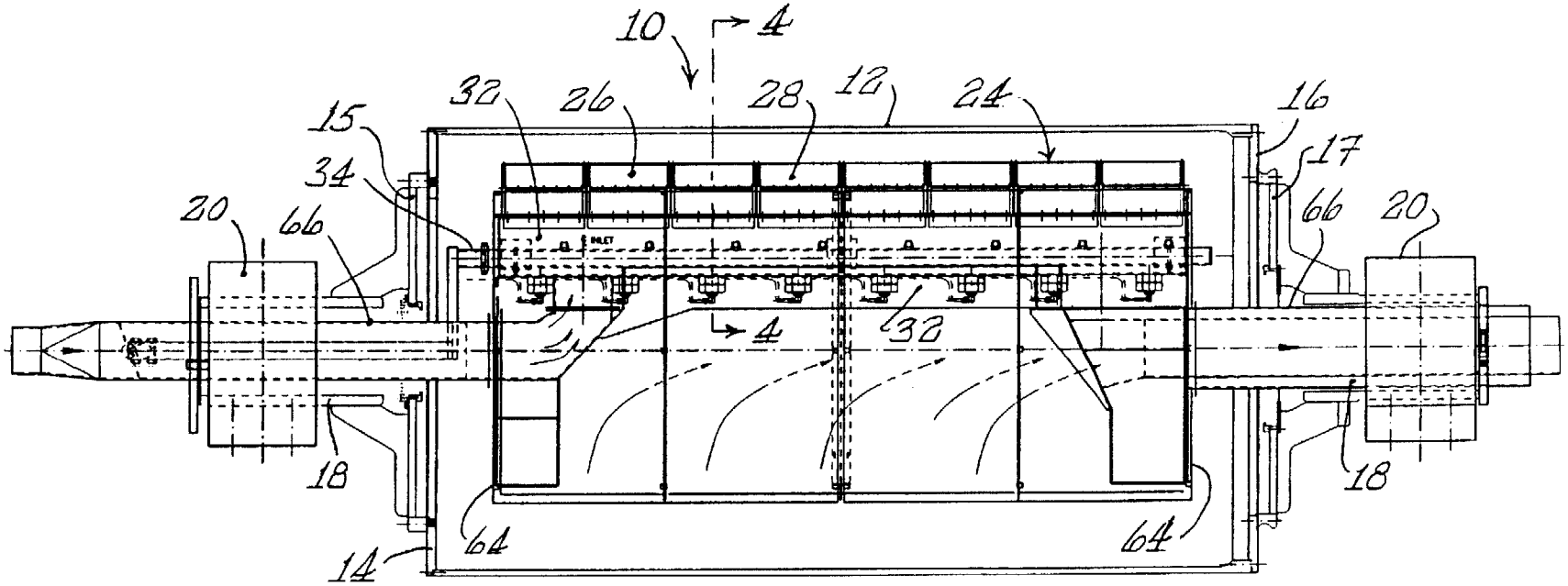
FIG. 1 is a sectional elevation view through the gas heated dryer.

Referring to FIG. 1, a gas fired drying cylinder indicated generally at 10 includes a cylindrical shell 12 manufactured from cast iron, fabricated steel or other suitable material. The cylindrical shell 12 has end wall heads 14, 16 secured thereto and, while not shown, the heads would be internally insulated with high temperature insulation.

The heads 14, 16 are supported on journals 18 which are mounted on bearings 20 located outboard of the heads, as is common practice, to allow the drying cylinder to rotate freely. Being so mounted, the bearings are isolated from the high surface temperature of the drying cylinder and this allows the use of standard bearings and lubrication systems. The drying cylinder 10 is rotated by means of a travelling fabric 22 (FIG. 3) passing over the surface of the shell 12, sufficiently high tension being applied to the fabric to impart rotation of the dryer. Alternatively, one of the dryer journals 20 would be fitted with a gear or toothed sprocket to permit it to be driven by a separate motor system.

Figure 3:
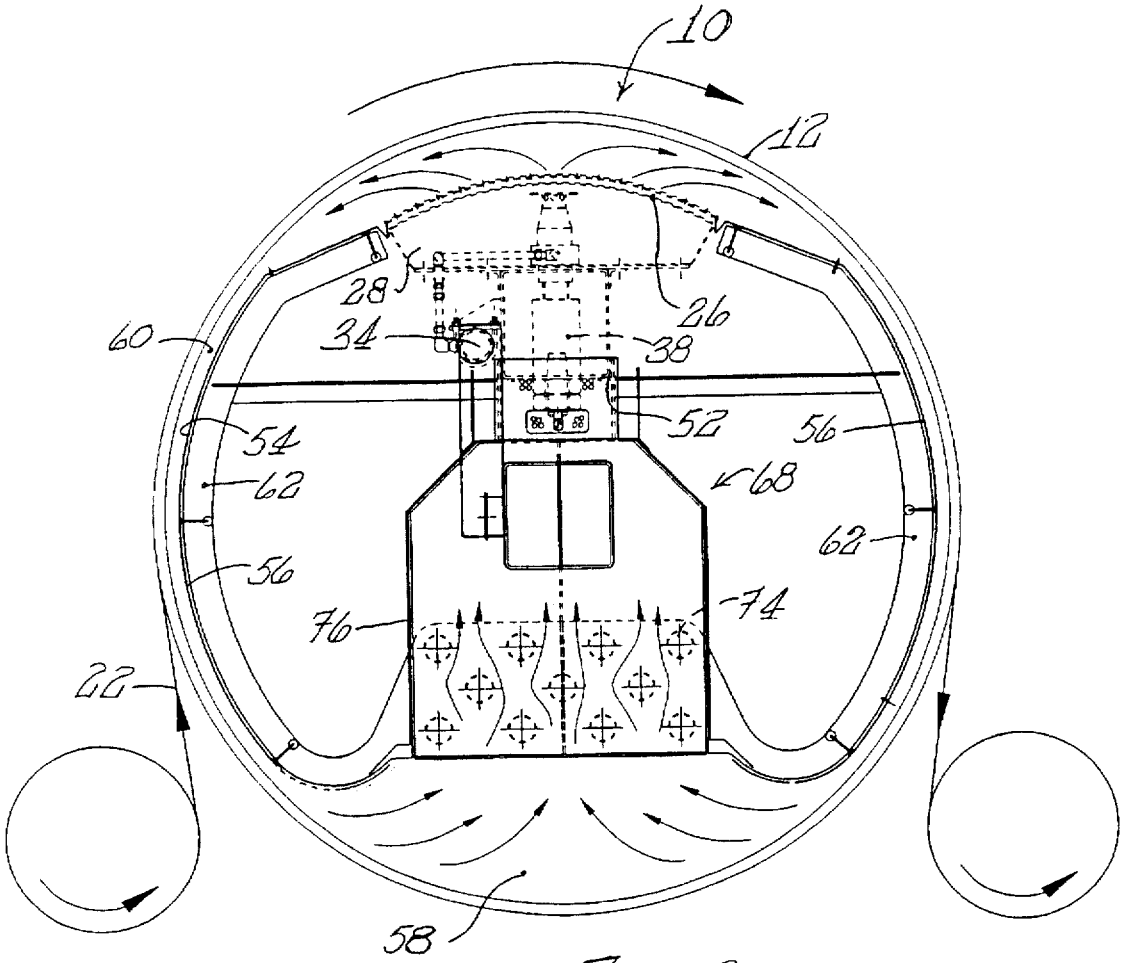
FIG. 3 is a sectional view taken along line 3—3 of FIG. 2.

A burner assembly indicated generally at 24 is non-rotatably disposed within the cylinder 10 and, as seen in FIGS. 1 and 3, is located adjacent the upper portion of the interior of the dryer shell 12 and burns a fuel/air mixture to transfer hot combustion gases, as indicated by the arrows in FIG. 3, by convection and infrared radiation about the interior of the dryer shell 12. As shown in FIG. 3, the infrared burner assembly 24 has its heat emitting surfaces 26 mounted in close proximity to the inside of the shell.

FIG. 1 illustrates the burner assembly 24 having a plurality of individual burner segments 28 along the length thereof. The heat output of each of the burner segments 28 is individually controllable or all of the segments in the assembly 24 can be controlled in unison.

The heat emitting surface 26 of each of the burner segments 28 is made of a porous material such as ceramic fibre or metal fibre and combustion of the fuel/air mixture occurs on or near the surface 26 of the burner causing the material to be heated to temperatures in the range of 1800° to 2000° F. Approximately 40 to 45% of the energy released from combustion is transferred as infrared radiation from the surface 26 of the burner as well as the hot combustion gases to the dryer shell 12.

The length of the burner assembly 24 would be determined by the width of the web being dried. The width of the burner or "burner wrap" is determined by the total heat output required, which is dependent on the location of the dryer cylinder in the drying section. As previously mentioned, in a conventional drying section the first few dryers are usually operated at low steam pressure (5 to 30 psig) in order to gradually warm up the web and to avoid sticking the sheet to the dryer or "picking". The actual pressure and temperature is highly dependent on the type of paper and type of fibre used. At the finish end of the dryer section, the web is quite dry, usually 90 to 95%, and little of no evaporation occurs. Therefore, the bulk of the heat into the web goes to sensible heating of the fibre which requires only a small portion of the heat input relative to a dryer located in the middle of the dryer section where the web is wet.

Accordingly, in a dryer section comprised partially or totally of gas heated dryers according to the invention, individual dryer cylinders could have different burner wraps to suit the local drying conditions. In practice, the burner width would be determined from the local maximum drying requirements and the maximum burner heat output per unit area. Although the burner heat output can vary over a wide range, it is generally from 20 to 100% of a given nominal output. In some conditions such as when there if no sheet on the dryer, for example during a sheet break or threading up of the dryer, it could be necessary to shut the burner off entirely.

Figure 4:
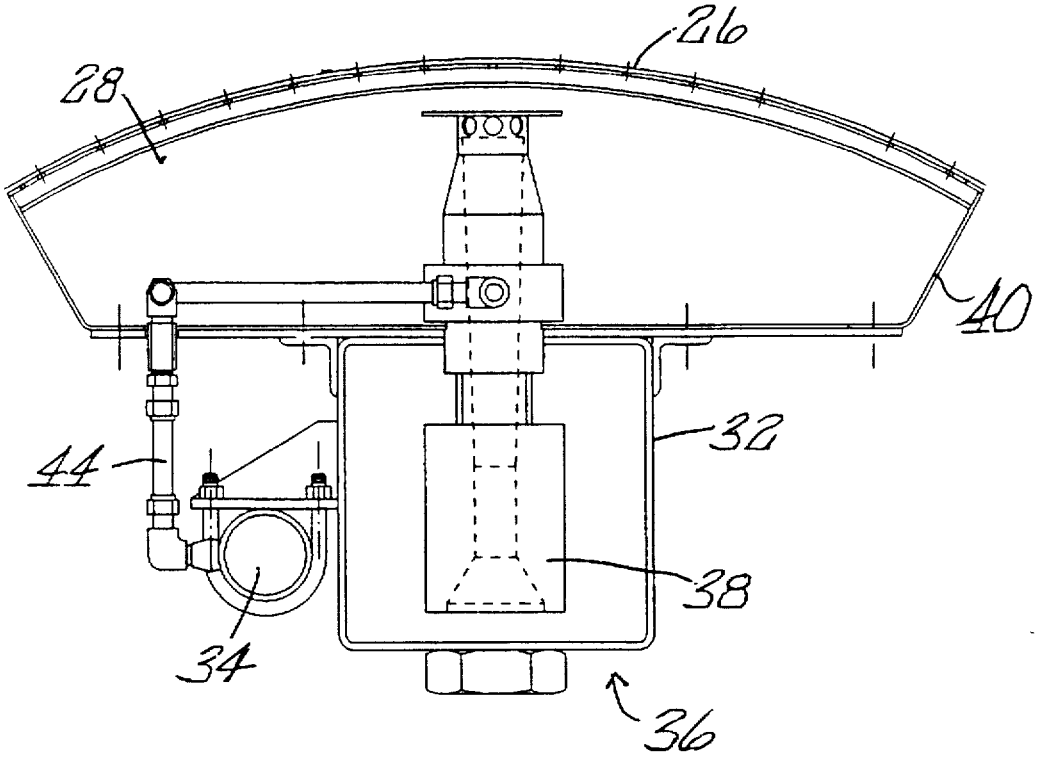
FIG. 4 is a sectional view taken along line 4—4 of FIG. 1 through a burner segment showing the burner plenum, air header, gas header and venturi mixer.

The burner assembly 24 is supported by a hollow rigid structure 32 as seen in FIG. 4 and this structure also serves as a header for the combustion air. A separate gas header 34 runs parallel to the air header 32.

The fuel/air mixing system is indicated generally at 36 in FIG. 4 and consists of individual venturi mixers 38, one for each burner section 28. The mixer 38 of each segment is interconnected between the combustion air header 32 and the plenum 40 of the burner 28. Fuel is piped to the venturi 38 from the gas header 34 via suitable piping 44.

The advantage of piping the air and gas in separate headers 34 and 32 as opposed to pre-mixing the air and gas outside of the dryer cylinder and piping it in a common header, is that the risk of fire and/or explosion is greatly reduced in the event that a pipe joint or the like should develop a leak. By not pre-mixing the fuel/air mix, the risk of flash back or auto-ignition is substantially reduced if any of the burner piping were to get heated to temperatures greater than the auto-ignition temperature.

Figure 5:
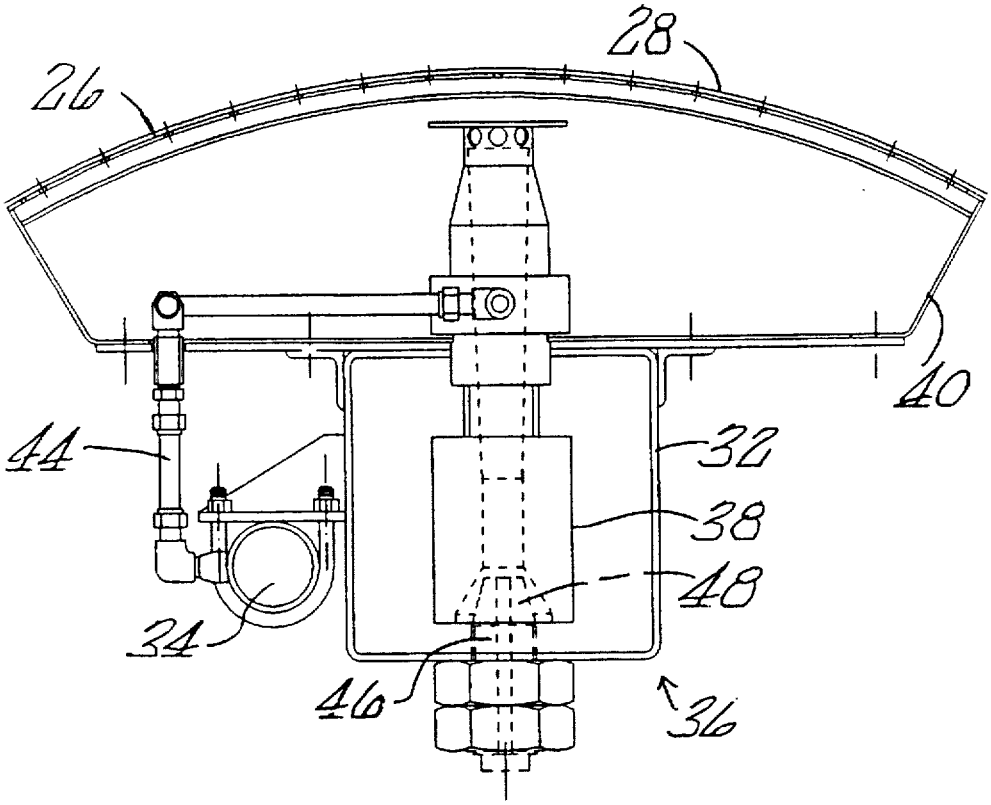
FIG. 5 is a sectional view similar to FIG. 4 with the trimming valve shown.

To ensure the uniformity of firing rate across the length of the burner assembly 24, the flow through each venturi can be balanced by means of a trimming valve in the form of a tapered plug 46 (FIG. 5) which is mounted on the air inlet and it can be moved in or out of the venturi throat 48 as required in order to ensure that the venturies deliver equal flow across the burner length. Other trimming devices can be used to balance the venturies in addition to the examples shown.

The firing rate of the burner segments 28 may be adjusted individually, or in unison. By increasing or decreasing the pressure of the combustion air in the header 32, the heat output from each segment may be increased or decreased as desired.

In order to permit the control of the firing rate of an individual burner segment 28, the flow of air through that venturi can be increased by introducing a source of secondary air piped through the centre of the tapered plug and injected into the venturi throat. FIG. 6 illustrates the secondary air source 50 so connected to the venturi. The secondary air in turn induces more primary combustion air into the venturi throat. The increased air flow through the venturi in turn induces a greater gas flow and the firing rate of that burner segment is thereby increased. The heat output of any burner segment may be modulated by varying the pressure of the secondary combustion air line 51 which is piped in separately from the main combustion air. The flow of secondary combustion air is externally controlled by means of a pressure regulator, not shown.

The air fuel metering device 36 is unique in that no moving parts are employed in the fuel/air mixing process. This means that no maintenance is required or adjustment needed other than that at the initial assembly phase. This advantage will be evident to those skilled in the art of maintaining paper machinery.

As illustrated in FIG. 3, the burner assembly and its supporting structure are mounted on rails 52 so as to be removable through access ports 15, 17 in the end wall head 14 or 16 of the dryer cylinder. This allows burner maintenance to be carried out outside the dryer without having to remove the dryer in its entirety.

To facilitate enhancement of heat transfer from the combustion products, the burner assembly 24 is located within a group of baffle plates 54 which make up two semi-circular assemblies 56. The upper end of the assembly 56 is located adjacent the side edges of the burner segments 28, the other end defining an opening or mouth 58 diametrically opposite the burner and into which flows the combustion products. As illustrated by the arrows in FIG. 3, the combustion products flow from the burner surface 26 around the inside of the dryer shell in the space defined by the inside of the shell and the outside of the baffle plates 54.

The space 60 between the interior of the dryer shell 12 and the exterior of the baffle 54 is carefully selected to ensure a significant convective heat transfer from the combustion products and shell. Additionally, the baffles become sufficiently hot as to radiate heat into the shell. The inside surface of the baffles may be covered with insulating material 62 to minimize heat transfer to the space enclosed by the plates. The heat recovered from convection and radiation from the baffle section is approximately 15 to 20% of the energy of combustion of the fuel.

The baffle section is closed at either end by walls 64 as shown in FIG. 1.

The entire interior assembly is supported at either end by conduits 66 which run concentric to the dryer access through the journal of the dryer shell.

In the FIG. 1 embodiment of the invention, combustion air is introduced through the centre of the front side support conduit 66 and the combustion products are removed through the rear support conduit 66 as indicated by the arrows.

Alternately, combustion air and combustion products could be conveyed from the same end through two separate concentric conduits with the flow being counter current to one another. At the opposite end, the burner assembly support would be a simple arrangement not used for conveying air or combustion products.

Figure 2:
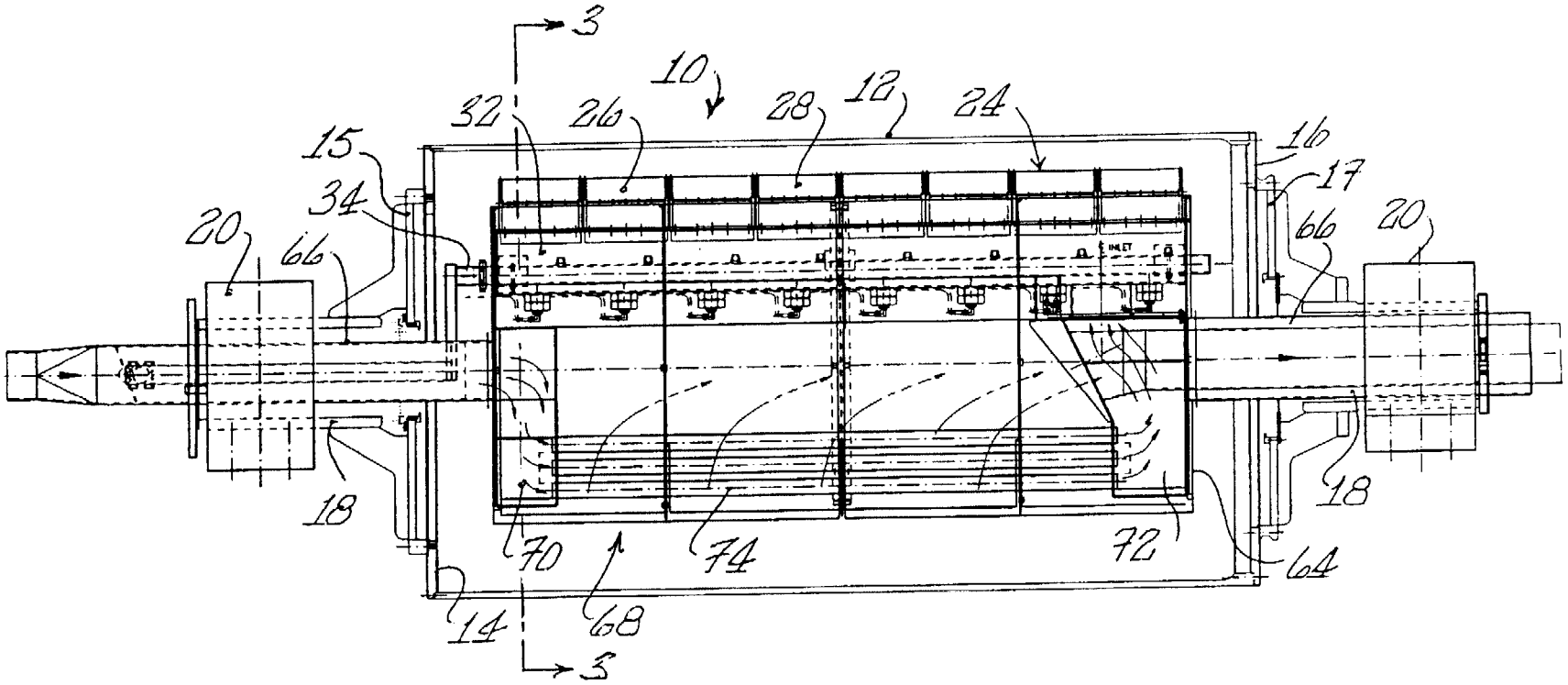
FIG. 2 is a sectional elevation view through another embodiment of the gas heated dryer.

As shown in FIGS. 2 and 3, a further improvement in thermal efficiency can be achieved by adding a recuperator or heat exchanger indicated generally at 68 thus capturing some of the heat in the combustion products to preheat the incoming combustion air. The combustion air support pipe connects to a plenum 70, FIG. 2, located in the front side of the baffle. The front side plenum is in turn connected to a plenum 72 at the rear end of the cylinder by means of a series of rows of tubes 74 through which the combustion air flows.

The combustion products having passed between the baffle section and the interior of the dryer shell 12 flow into the slot opening 58 at the bottom of the baffle. A chamber 76 inside the baffle section defines an area around the combustion air heat recovery tubes 74 over which the combustion products flow thereby providing a heat transfer to the combustion air. Pre-heating of the combustion air products allows for recovering of an additional 10% of the energy released during combustion of the fuel and the burner. The combustion products having heated the combustion air are channelled from the heat recovery section by means of a duct out the air pipe at the rear end of the dryer.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

We claim:

1. A gas fired drying cylinder comprising a cylindrical shell having end wall heads secured thereto, an interior surface and an exterior surface over which a material to be dried is engaged, said drying cylinder being mounted for rotation about its central longitudinal axis; a burner assembly non-rotatably disposed within said cylinder and located adjacent the dryer shell interior for burning a fuel/air mixture to transfer hot combustion gases by convection and infrared radiation about the interior of said dryer shell; said burner assembly having a plurality of burner segments along the length thereof, the heat output of said burner segments being individually controllable or controllable in unison said end wall heads including access ports for removal of said burner assemble therethrough.

2. A gas fired drying cylinder according to claim 1 including, within the shell interior, a plurality of baffle plates extending the length of said burner assembly and forming a peripheral enclosure extending outwardly of the burner assembly and substantially coaxial with the longitudinal axis of said cylinder, said baffle plates defining a peripheral space adjacent the inner surface of said shell and through which combustion gases flow.

3. A gas fired drying cylinder according to claim 1 including bearing-mounted, support journals located outboard of said end wall heads, apertures in at least one of said journals in communication with the interior of said shell whereby air, gas and combustion products are ducted in and out of said drying cylinder.

4. A gas fired drying cylinder according to claim 1 including a support conduit supporting said burner assembly, said conduit serving to supply air to individual segments of said burner, and a fuel/air mixing apparatus interconnecting said support conduit and said burner assembly.

5. A gas fired drying cylinder according to claim 4 wherein said fuel/air mixing apparatus includes a venturi mixer to meter the flow of fuel/air into said burner segments and a trimming device to balance the mixers on individual burner segments.

6. A gas fired drying cylinder according to claim 1 adapted for operating temperatures from 300° F. to 600° F.

7. A gas fired drying cylinder according to claim 1 including a heat exchanger extending substantially the length of said burner assembly and enveloping fuel/air feed conduits to said venturi mixers, said heat exchanger causing combustion gases to flow around said fuel/air feed conduits to preheat said fuel/air mixture.

* * * * *